US008186373B2

(12) United States Patent
Huang et al.

(10) Patent No.: US 8,186,373 B2
(45) Date of Patent: May 29, 2012

(54) ROTATABLE DUAL HEAD INFLATION DEVICE

(76) Inventors: Ying-Che Huang, Sioushuei Township, Changhua County (TW); Chun-Ming Huang, Sioushuei Township, Changhua County (TW)

( * ) Notice: Subject to any disclaimer, the term of this patent is extended or adjusted under 35 U.S.C. 154(b) by 394 days.

(21) Appl. No.: 12/647,678

(22) Filed: Dec. 28, 2009

(65) Prior Publication Data

US 2011/0155260 A1 Jun. 30, 2011

(51) Int. Cl.
*F16K 15/20* (2006.01)

(52) U.S. Cl. ..... 137/231; 137/223; 137/270; 285/354

(58) Field of Classification Search ..... 137/223, 137/228, 230–233, 269–271; 285/354, 12; 251/149.1, 149.4
See application file for complete search history.

(56) References Cited

U.S. PATENT DOCUMENTS 5,983,920 A * 11/1999 Gapinski et al. ..... 137/231
6,076,544 A * 6/2000 Pierce ..... 137/223
6,220,836 B1 * 4/2001 Wu ..... 137/231
6,260,572 B1 * 7/2001 Wu ..... 137/231
6,276,391 B1 * 8/2001 Wu ..... 137/223
7,309,034 B2 * 12/2007 Huang ..... 239/589
7,588,048 B2 * 9/2009 Huang ..... 137/231
7,661,435 B2 * 2/2010 Huang ..... 137/231
7,963,297 B2 * 6/2011 Huang et al. ..... 137/231
2011/0123262 A1 * 5/2011 Huang et al. ..... 403/299

* cited by examiner

*Primary Examiner* — John Rivell
*Assistant Examiner* — Craig J Price
(74) *Attorney, Agent, or Firm* — Rabin & Berdo, P.C.

(57) ABSTRACT

An inflation device includes a central tube, a first mounting unit mounted onto an outside of a reception end of the central tube and a second unit connected to a connection portion on the other end of the central tube. The first mounting unit includes a first casing and an end cap, and the reception end includes a valve mouth and a core tube received therein. The second mounting unit includes inner threads that are connected with the connection portion. A groove is defined in the second mounting unit and an O-ring is engaged with the groove. The first and second mounting units can be connected with an American style tire valve and a French style tire valve, respectively. The first and second mounting units each have outer threads with the same diameter so as to be connected with a tire pump.

16 Claims, 9 Drawing Sheets

ROTATABLE DUAL HEAD INFLATION DEVICE

BACKGROUND OF THE INVENTION

1. Field of the Invention

The present invention relates generally to a rotatable dual head inflation device, and in particular to a rotatable dual head inflation device which can be used with a French style tire valve and an American style tire valve.

2. The Prior Arts

FIGS. 1A and 1B are cross sectional views showing two conventional rotatable inflation devices 7, 8 which are invented by the applicants, and are designed to cooperate with a French style tire valve and an American style tire valve. The inflation devices shown in FIGS. 1A and 1B are to replace the clamp-style with the rotatable style when connected with the French style tire valve and the American style tire valve. By the rotatable and threaded connection, the two styles of the valve mouths can be securely connected with the inflation devices. The rotatable and threaded connection ensures that the inflation device is firmly connected to the tire valve while the clamp-style inflation device only uses a rubber washer to clamp the outside of the tire valve. The clamp style connection lacks axial force so that the huge pressure during inflation action may separate the inflation device from the tire valve. Therefore, the rotatable style inflation device is more suitable for the high pressure inflation device such as Carbon-dioxide inflation device.

FIG. 1A shows the conventional rotatable inflation device 7 suitable for the French style tire valve F and FIG. 1B shows the conventional rotatable inflation device 8 suitable for the American style tire valve U. Each of the inflation devices includes a central tube 60 which includes a reception chamber 61 at one end and a valve mouth 72/82 is received in the reception chamber 61. The difference between the valve mouths 72 and 82 is that the valve mouth 72 is to be connected with the French style tire valve F and seals at the shoulder portion of the French style tire valve F, and an inlet end of the French style tire valve F can insert into the valve mouth 72. A core tube 83 is received in the central hole of the valve mouth 82 and the outer contour of the core tube 83 is corresponding to the central hole of the valve mouth 82. The core tube 83 has multiple passages 832. A core piece 831 is formed at the center of the passages 832 so as to push the rod of the American style tire valve U to introduce the pressurized air into the tire. In addition to the reception chamber 61, the central tube 60 includes a guide tube 62 at an end opposite to the reception chamber 61. Referring to FIGS. 2A and 2B, the guide tube 62 of the central tube 60 has two different connection forms. FIG. 2A shows a threaded rod 63 is connected to the guide tube 62 and the threaded rod 63 is connected to the head 51 of the tire pump 50. The head 51 is connected with the body 52 and includes a passage 511 which includes an outlet end 512 having inner threads so as to be connected with the threaded rod 63. A recess is defined in the opening of the outlet end 512 and an O-ring 513 is engaged with the recess so as to form a sealing feature when the threaded rod 63 is connected to the outlet end 512. Referring to FIG. 2B, the other form of the guide tube 62 includes a connection end 64 which is connected with a hose 53 of the tire pump (not shown). An end mount 531 is mounted to hold the hose 53 and the connection end 64 so as to reinforce the connection.

Referring to FIGS. 1A and 1B, the central tube 60 of the inflation device 7/8 is received in a casing 70/80. The casing 70/80 includes an inner space 701/801 enclosing the wall of the reception chamber 61. A first threaded portion 702/802 is defined in an open end of the casing 70/80 and the other end of the casing 70/80 includes a connection end 703/803 which has a second threaded portion 704/804 at the axial direction of the inflation devices 7/8. The difference between the second threaded portions 704 and 804 is that the diameter of the second threaded portion 704 is corresponding to the threaded portion of the French style tire valve F and the second threaded portion 804 is corresponding to the threaded portion of the American style tire valve U, such that the second threaded portions 704 and 804 can be threadedly connected with the French style tire valve and the American style tire valve, respectively. A ring-shaped end cap 71/81 is sleeved on the outside of the guide tube 62 and is provided with an opening 711/811 defined centrally therethrough such that the guide tube 62 is engaged with the opening 711/811. The end cap 71/81 includes a third threaded portion 712/812 which is threadedly connected with the first threaded portion 702/802 to connect the end cap 71/81 to the casing 70/80, and mounted to the outside of the reception chamber 61.

The characteristic of the inflation device 7 for the French style tire valve F and the inflation device 8 for the American style tire valve U is that the reception chamber 61 couples with the casing 70/80. The user only needs to change the casing 70/80 and the valve mouth 72/82 on the tire pump 50, then the tire pump 50 can be connected with the French style tire valve F and the American style tire valve U. It can reduce the manufacturing cost and is easy to change the parts. Moreover, the inflation device 7/8 is threadedly connected to the tire valves, which overcomes the disadvantage of the conventional clamp-type inflation device. However, the inflation devices 7 and 8 can not be cooperated with the tire pump 50 and the hose 53 simultaneously. Therefore, the inflation devices 7 and 8 are two independent units. The user has to keep the tire pump 50 and the two inflation devices 7 and 8 at hand. It is inconvenient.

SUMMARY OF THE INVENTION

A primary objective of the present invention is to provide a rotatable inflation device which is equipped with a dual head part which is suitable for a French style tire valve and an American style tire valve so that the users do not need to prepare two individual inflation devices to cooperate with different styles of tire valves.

The inflation device according to the present invention includes a central tube, a first mounting unit mounted onto the outside of a reception end of the central tube and a second unit connected to a connection portion on the other end of the central tube. The first mounting unit includes a first casing and a locking ring, and the reception end includes a valve mouth and a core tube received therein. The first casing is connected with the locking ring, and the reception end of the central tube is enclosed between the first casing and the locking ring. The second mounting unit includes a second casing which has inner threads to connect with the connection portion. A groove is defined in the second mounting unit and an O-ring is engaged with the groove. The first mounting unit and the second mounting unit respectively have a first threaded hole and a second threaded hole on the same axial axis. The first threaded hole and the second threaded hole are cooperated with an American style tire valve and a French style tire valve, respectively. The American style tire valve enters the first mounting unit via the first threaded hole and is engaged with the valve mouth and the core tube and opens the tire valve to inflate the tire. The French style tire valve enters the second mounting unit via the second threaded hole. The valve on the front end of the French style tire valve and the shoulder at the rear end thereof contacts the O-ring in the second casing to form a sealing feature to ensure the pressurized air can be introduced into the tire. The second characteristic of the present invention is that the first mounting unit and the second mounting unit each have outer threads with the same diameter so as to be connected with a tire pump. Therefore, the tire pump can be cooperated with both of the French style tire valve and the American style tire valve. Unlike prior art, which needs two individual inflation devices to be cooperated with the French style tire valve and the American style tire valve, the inflation device according to present invention needs only a single device to be cooperated with both styles of tire valves. The first and second mounting units are located on two ends of the central tube and air can flow through the first mounting unit, the central tube and the second mounting unit. The valve mouth and core tube corresponding to the American style tire valve and the O-ring corresponding to the French style tire valve provide sealing feature. Both ends of the inflation device can be connected to the tire pump. Moreover, both ends of the inflation device can be connected with the American style tire valve and the French style tire valve, respectively. The users can simply switch the directions to connect the inflation device to the tire pump, and therefore the inflation device according to the present invention allows the tire pump to pump air through the American style tire valve or the French style tire valve to the tire. Two grooves are defined on the outside of the central tube and respectively located close to the reception end and the connection portion, two O-rings are engaged with the two grooves so as to form proper sealing feature in the first and second mounting units. By this arrangement, there will be no leakage during inflating the tire.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1A:
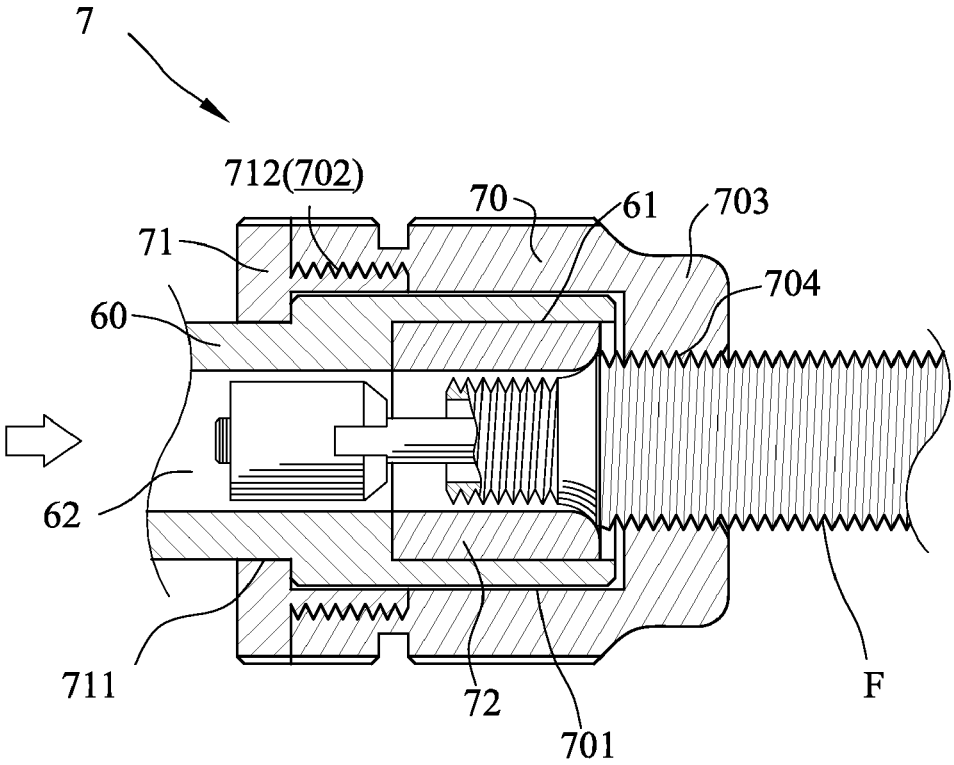
Fig. 1A(Prior Art)
FIGS. 1A and 1B are cross sectional views showing two conventional inflation devices connected with a French style tire valve and an American style tire valve, respectively.
Figure 1B:
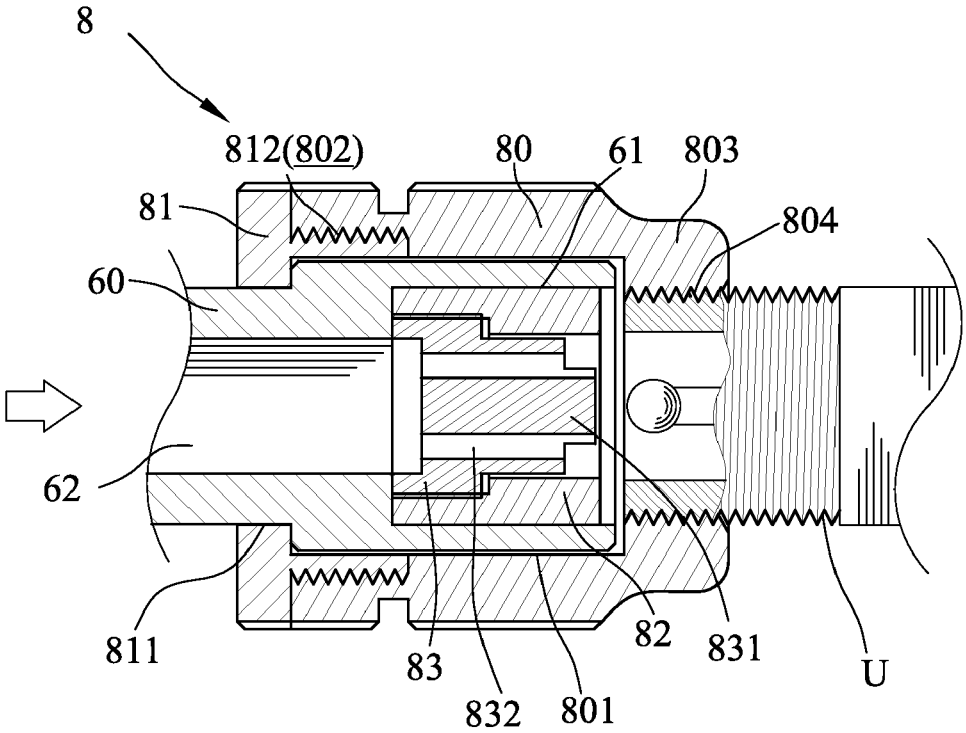
Fig. 1B(Prior Art)
Figure 2A:
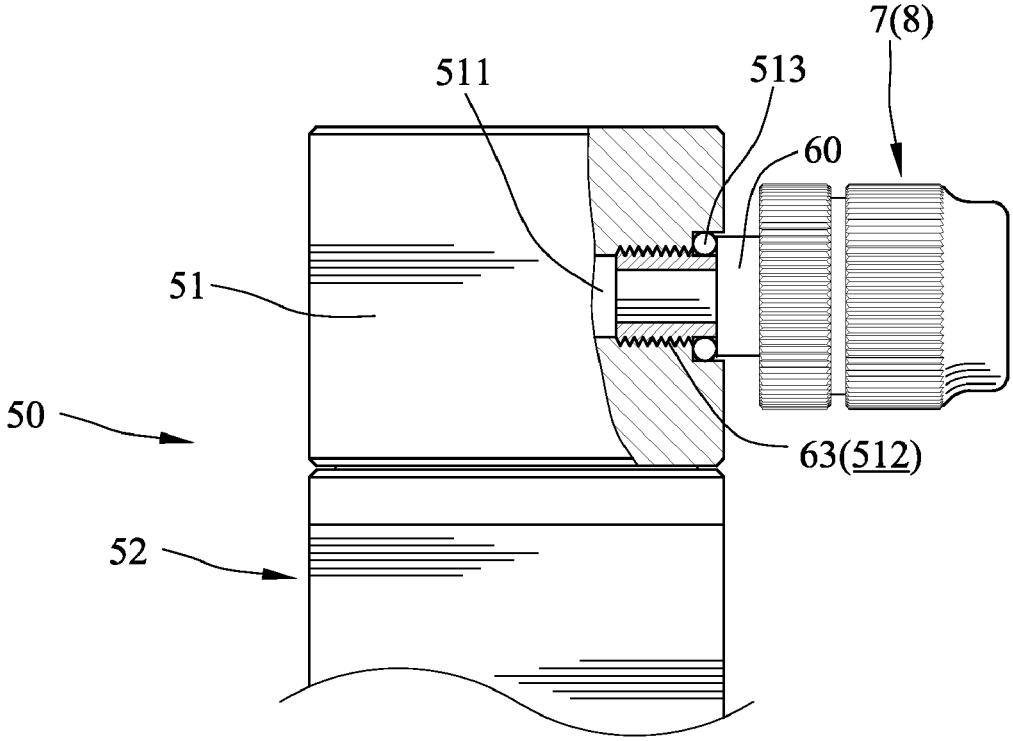
Fig. 2A(Prior Art)
FIGS. 2A and 2B are schematic views showing the conventional inflation devices connected with a tire pump and a hose, respectively.
Figure 2B:
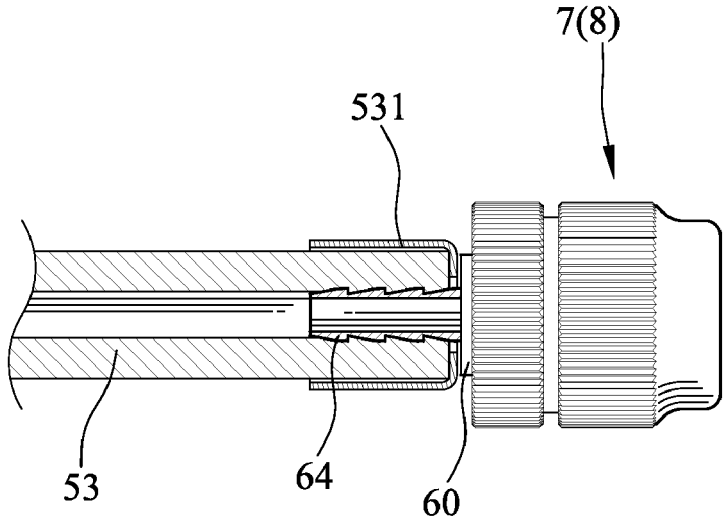
Fig. 2B(Prior Art)
Figure 3:
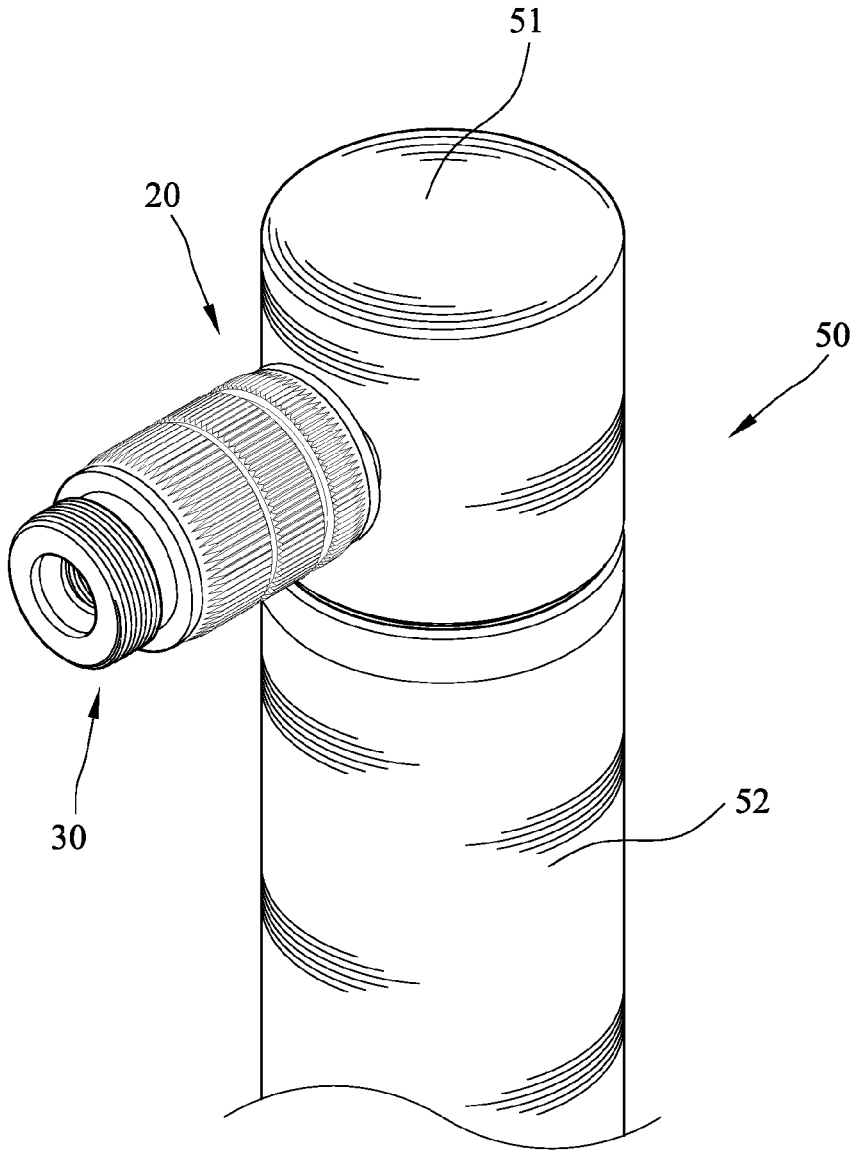
FIG. 3 is a perspective view showing an inflation device according to the present invention connected with a tire pump.

With reference to the drawings and in particular to FIG. 3, a tire pump 50 is the same as a conventional tire pump and includes a head 51 and a body 52. A rotatable dual head inflation device according to an embodiment of the present invention is connected to an outlet (not shown) of the head 51. The rotatable dual head inflation device includes a first mounting unit 20 and a second mounting unit 30, wherein the first mounting unit 20, the second mounting unit 30 and the head 51 are connected by rotation. The first mounting unit 20 and the second mounting unit 30 can switch the directions. That is, instead of the first mounting unit 20 directly connecting with the outlet of the head 51 of the tire pump 50, the second mounting unit 30 directly connects with the head 51.

Figure 4:
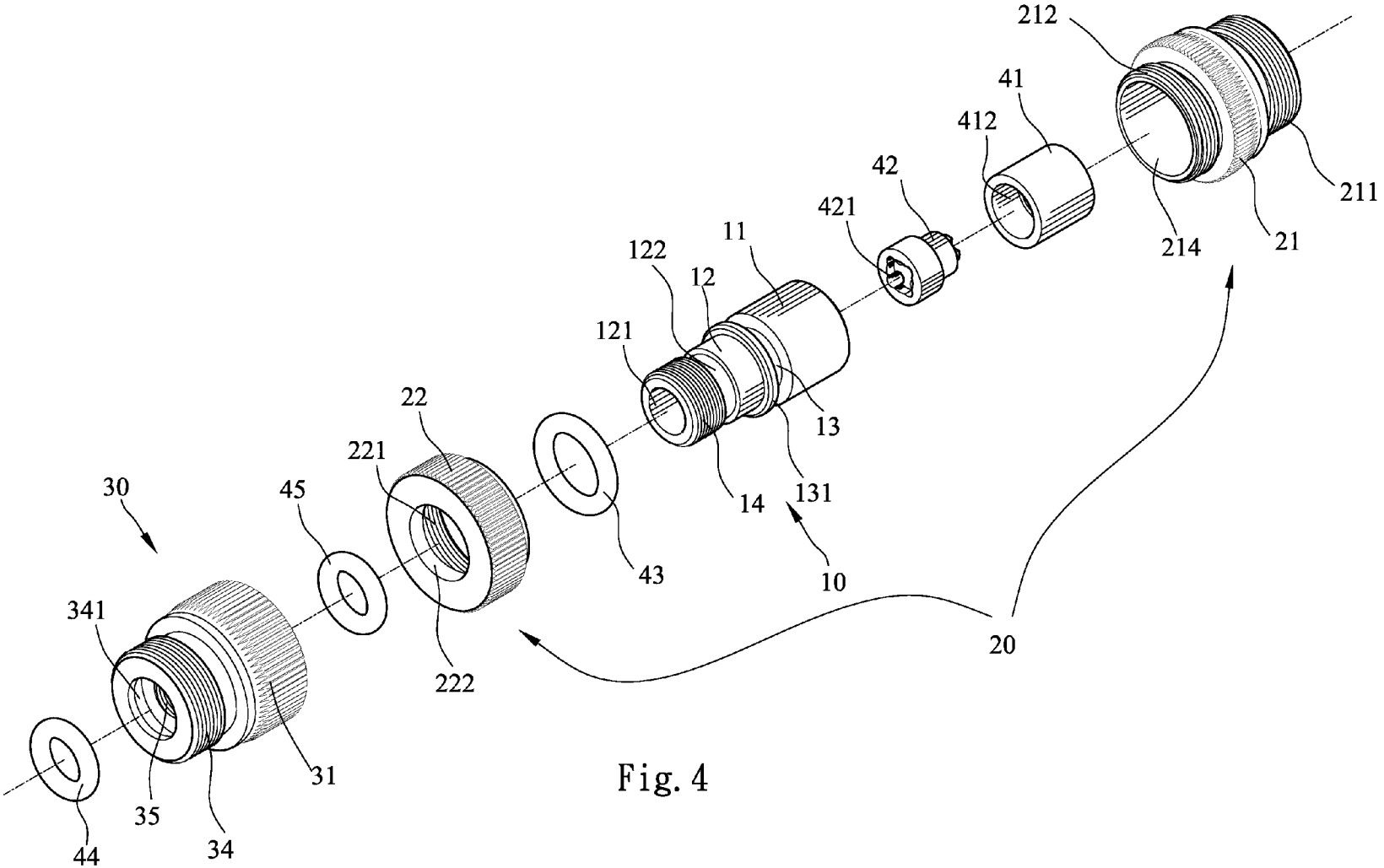
FIG. 4 is an exploded view showing the inflation device according to the present invention.
Figure 5:
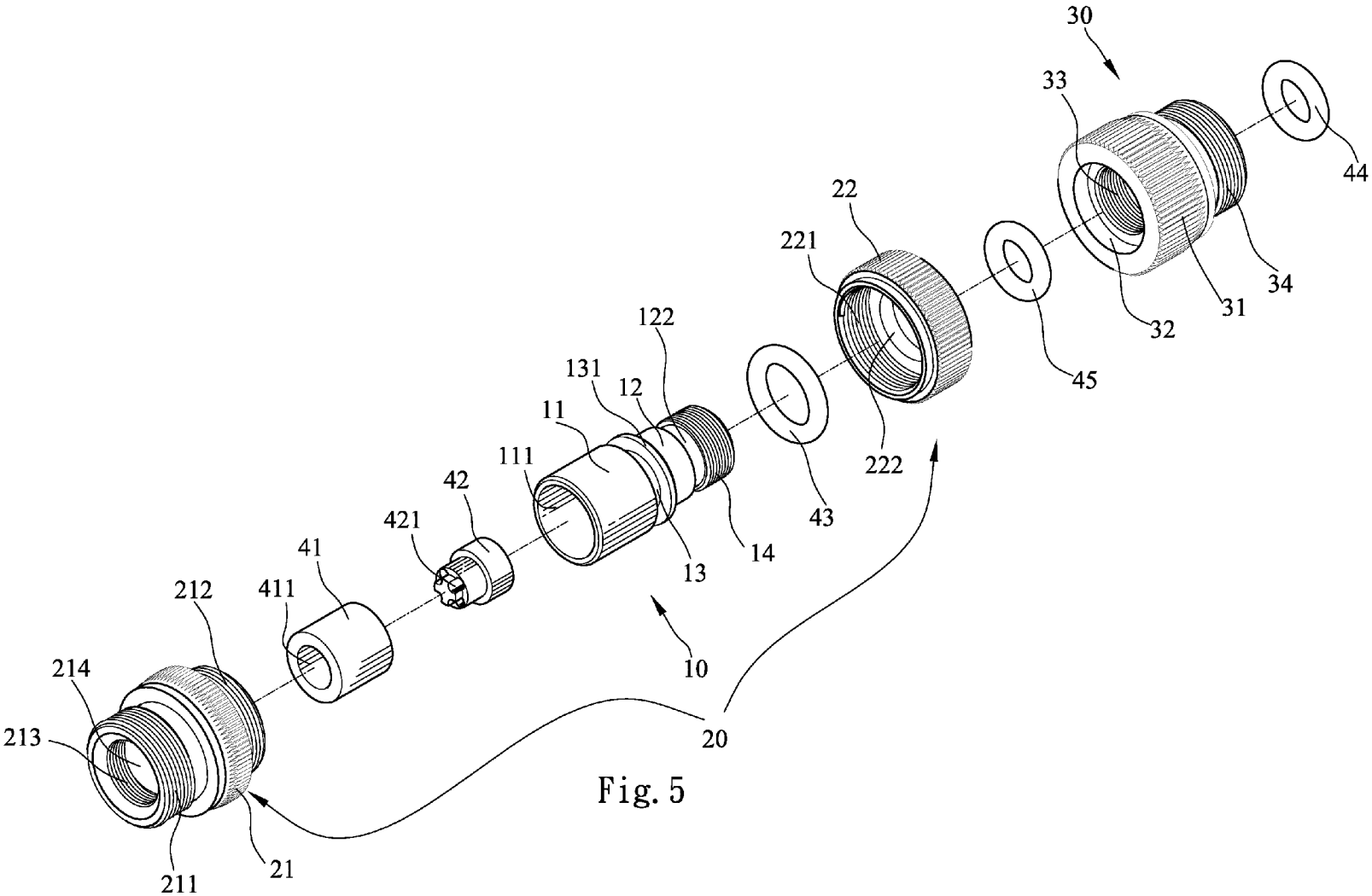
FIG. 5 is an exploded view showing the inflation device according to the present invention in another viewing angle.
Figure 6:
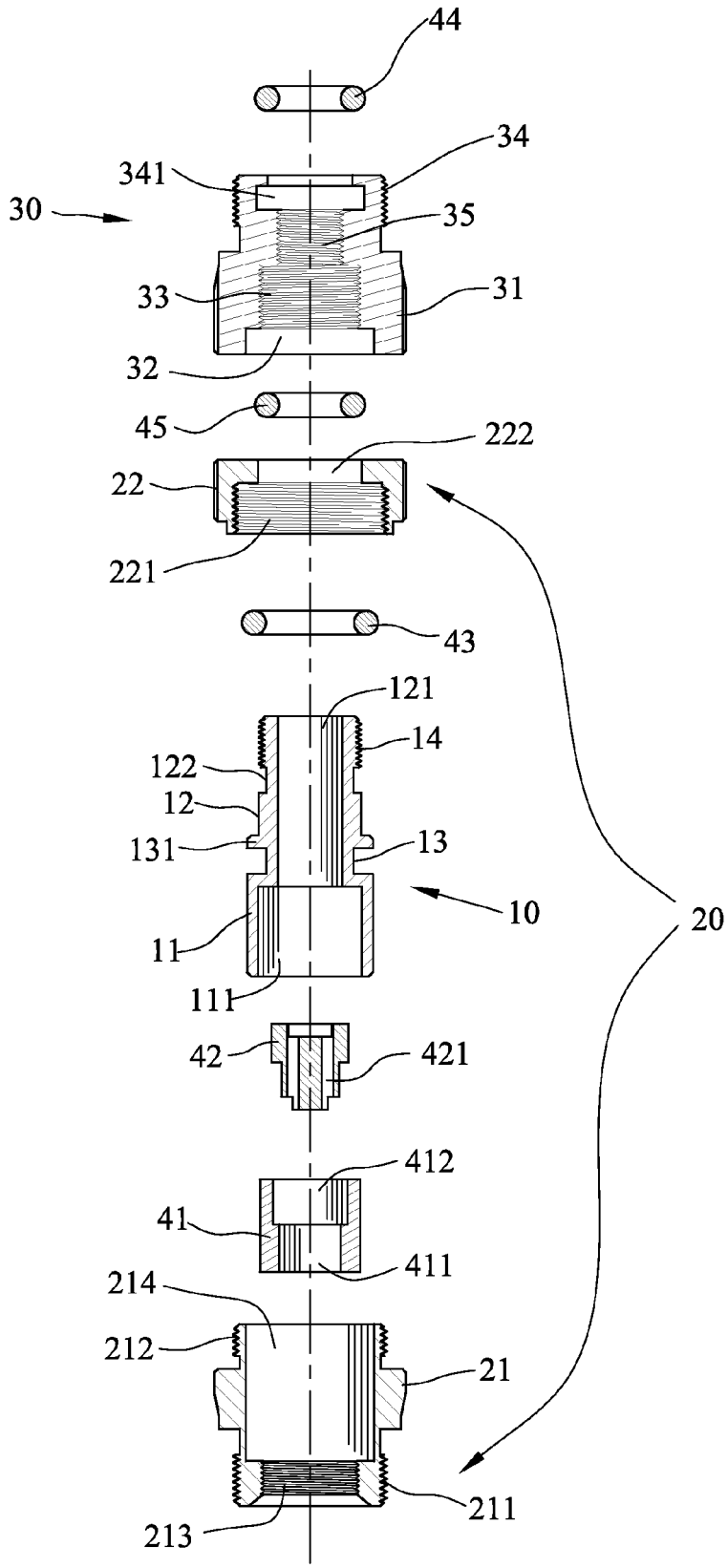
FIG. 6 is an exploded and cross sectional view showing the inflation device according to the present invention.

Referring to FIGS. 4, 5 and 6, the rotatable dual head inflation device according to the present invention includes a hollow central tube 10. The central tube 10 includes a reception end 11 at a first end thereof and a connection portion 12 at a second end thereof. A reception space 111 is defined in an inside of the reception end 11. A reception groove 13 defined on an outside of the central tube 10 and a flange 131 extended radially outward from the central tube 10 are located between the reception end 11 and the connection portion 12. The reception groove 13 is located beside the reception end 11 and the flange 131 is located beside the connection portion 12. A first O-ring 43 is engaged with the reception groove 13. Threads 14 are defined on an outer periphery of a distal end of the connection portion 12. An inner tube 121 is located at a center of the connection portion 12 and the inner tube 121 communicates with the reception end 111. A first groove 122 is defined on an outside of the connection portion 12 and a second O-ring 45 is engaged with the first groove 122. The first mounting unit 20 encloses the reception end 11 and a valve mouth 41 and a core tube 42 are received in the reception end 11. The outer diameter of the valve mouth 41 is slightly smaller than the inner diameter of the reception space 111 and the valve mouth 41 includes a first stepped hole 411 and a second stepped hole 412. The core tube 42 is shaped to be matched with the first stepped hole 411 and the second stepped hole 412 so as to be positioned therein. A plurality of passages 421 is defined through the core tube 42 and a core portion is formed and enclosed by the passages 421. The valve mouth 41 and the core tube 42 are the same as conventional ones and will not be described here. The first mounting unit 20 has a first casing 21 and a locking ring 22 which is sleeved on the connection portion 12. The first casing 21 includes a first threaded portion 212 defined outside thereof and the locking ring 22 includes a second threaded portion 221 to threadedly connect with the first threaded portion 212. An opening 222 is defined in the other side of the locking ring 22 and located in opposite to the second threaded portion 221. The inner diameter of the opening 222 is slightly larger than the outer diameter of the connection portion 12 but smaller than the outer diameter of the flange 131, so that the locking ring 22 is stopped by the flange 131. The first casing 21 includes first outer threads 211 defined on the outside of the opened end thereof and there is a portion having a larger outer diameter at the center of the first casing 21. The first threaded portion 212 is defined on the outside of the first casing 21 and disposed at an end opposite to the end having the first outer threads 211. The first threaded portion 212 is threadedly connected with the second threaded portion 221 of the locking ring 22. A first space 214 is defined in the first casing 21 such that the reception end 11 of the central tube 10 is received in the first space 214. The first casing 21 and the locking ring 22 are threadedly connected to enclose the reception end 11 of the central tube 10 therebetween. The inner diameter of the first space 214 is larger than the outer diameter of the reception end 11 so that the first mounting unit 20 can be rotatable relative to the reception end 11. The inner periphery of the first space 214 contacts the first O-ring 43 to form a sealing feature. A first threaded hole 213 is defined in an inner periphery of the first outer threads 211 so as to be connected with the threaded rod of the American style tire valve to allow the American style tire valve to be entered into the first mounting unit 20. The second mounting unit 30 is connected to the connection portion 12 of the central tube 10 and includes a second casing 31. The second casing 31 includes inner threads 33 defined therein which are threadedly connected to the threads 14 of the connection portion 12. The inner threads 33 of the second casing 31 and the threads 14 of the connection portion 12 may be further fixed by glue so that the second casing 31 is co-rotated with the central tube 10. A second threaded hole 35 is defined in an inside of the second mounting unit 30 and located on the same axis of the inner threads 33. A second groove 341 is defined beside the second threaded hole 35 and a third O-ring 44 is engaged with the second groove 341 to provide sealing feature. The second threaded hole 35 is able to be connected with the threaded rod of the French style tire valve to introduce the French style tire valve into the second mounting unit 30. It should be noted that the threaded rod of the French style tire valve has a smaller diameter than that of the threaded rod of the American style tire valve. A second space 32 is defined beside the inner threads 33 and the inner periphery of the second space 32 contacts against the second O-ring 45 to form a sealing feature after the second casing 31 is installed to the connection portion 12 of the central tube 10.

Figure 7A:
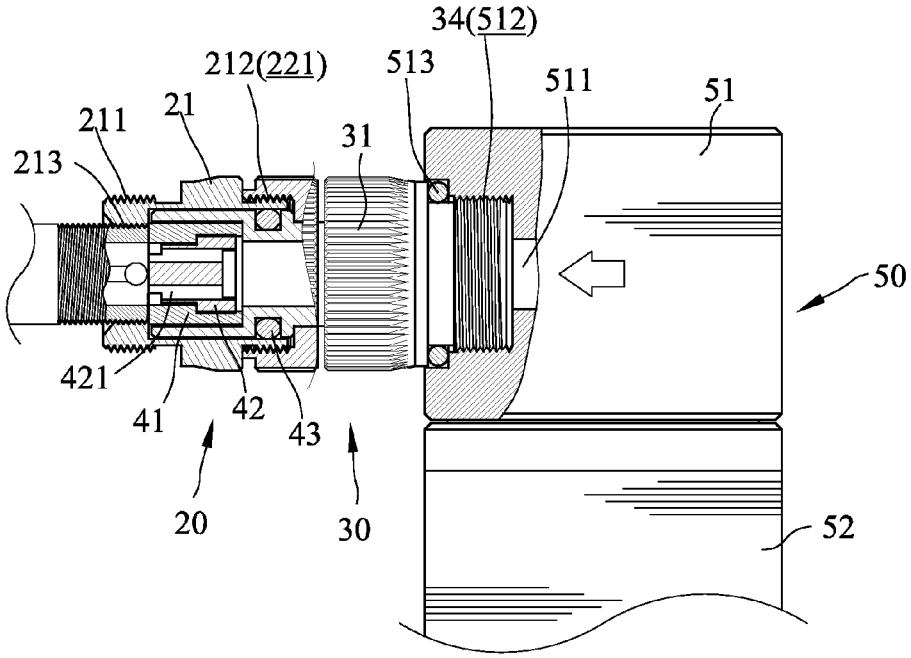
FIGS. 7A and 7B shows that the inflation device according to the present invention is connected with the American style tire valve and the French style tire valve, respectively.
Figure 7B:
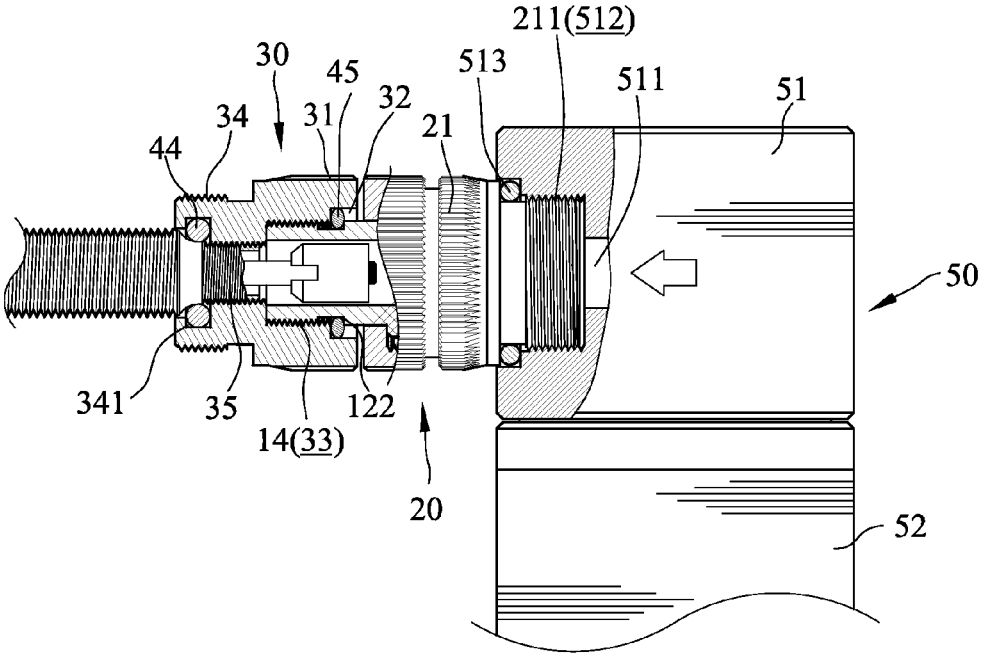

Referring to FIGS. 7A and 7B, the advantages of the present invention are described as follows. First of all, the first threaded hole 213 of the first casing 21 and the second threaded hole 35 of the second casing 31 are located at the same axis and on two ends of the central tube 10 so that the American style tire valve and the French style tire valve can be respectively connected to the two ends of the central tube 10. The American style tire valve is connected with the first threaded hole 213 and enters into the first mounting unit 20 and is engaged with the valve mouth 41. The core tube 42 pushes and opens the valve in the American style tire valve to inflate the tire. After switching the direction of the connected central tube 10, first mounting unit 20 and second mounting unit 30, the French style tire valve is connected with the second threaded hole 35 and enters into the second mounting unit 30. The valve at the front end of the French style tire valve and the shoulder at the rear end thereof are engaged with the O-ring 44 to form the sealing feature.

Secondly, the second casing 31 is fixed to the central tube 10, and the first casing 21 and the locking ring 22 are rotatable relative to the reception end 11. As shown in FIG. 7A, the second casing 31 is connected with the head 51 of the tire pump 50. When the first casing 21 and the locking ring 22 are threadedly connected to the American style tire valve, the central tube 10 and the second casing 31 are not affected by the rotating connection. The second casing 31 can still be securely fixed on the head 51 of the tire pump 50 without rotation. On the other hand, as shown in FIG. 7B, the first casing 21 is connected with the head 51 of the tire pump 50. When the second casing 31 is rotated to be connected with the French style tire valve, the rotation of the second casing 31 and the central tube 10 does not drive the first casing 21 and the locking ring 22 to rotate. Therefore, the dual head inflation device according to the present invention can be cooperated with both the French and American style tire valves.

Figure 8:
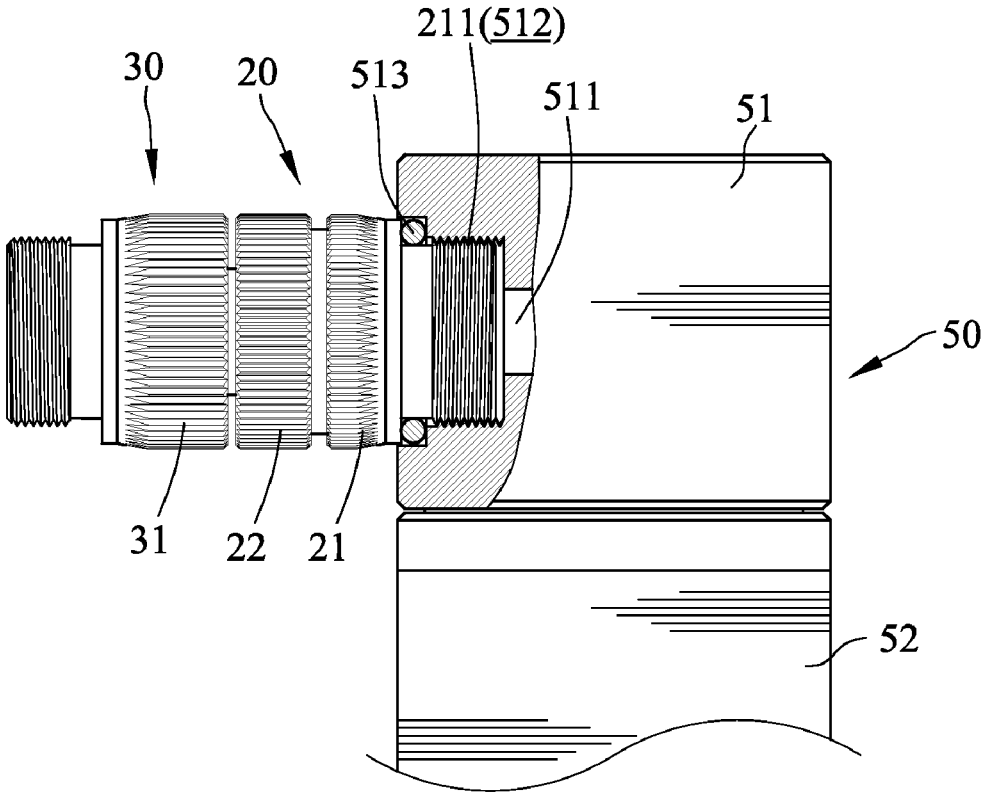
FIG. 8 is a schematic view showing the inflation device according to the present invention connected with the tire pump.
Figure 9:
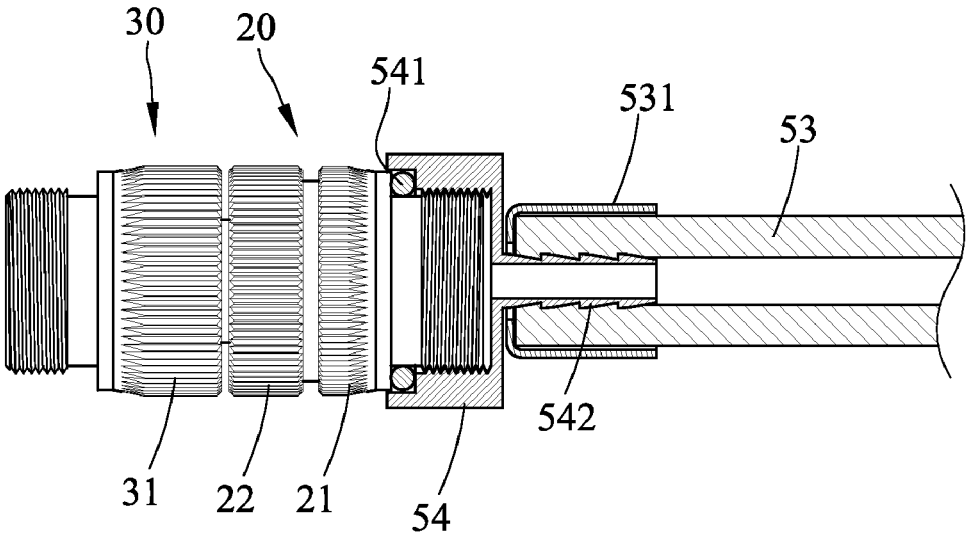
FIG. 9 is a schematic view showing the inflation device according to the present invention connected with a hose.

Thirdly, referring to FIGS. 8 and 9, the first and second threaded holes 213, respectively have the first outer threads 211 and second outer threads 34, wherein the first outer threads 211 and the second outer threads 34 have the same diameter. It allows the connected first and second casings 20, 30 to be connected with the same tire pump 50 without any adaptor. The connected first and second casings 20, 30 may be connected with the outlet end 512 of the tire pump 50 as shown in FIG. 8 or the connection member 54 on a hose 53 connected to the tire pump 50 as shown in FIG. 9. The connection member 54 includes inner threads which are designed to be corresponding to the first outer threads 211 and the second outer threads 34. An extension 542 is connected to the hose 53 so as to be connected to the tire pump. An O-ring 541 is connected to the open end of the connection member 54 so as to seal the connection with the first outer threads 211 or the second outer threads 34. The first casing 21 and the second casings 31 are respectively connected to two ends of the central tube 10 so that the different styles of tire valves can be cooperated with the first and second casings 21, 31 simply by switching the direction of the inflation device of the present invention.

Fourthly, the first casing 21, the locking ring 22, the central tube 10 and the second casing 31 are located on the same axis and are circular parts so that the manufacturing processes are simple and the manufacturing cost can be kept at low level. The circular cross section of the parts allow for easy mounting of the O-rings to perform good air-tight sealing function.

The rotatable dual head inflation device according to the present invention includes the valve mouth 41 and the core tube 42 to cooperate with the American style tire valve. The first casing 21, the valve mouth 41 and the core tube 42 can be replaced with another set having different specifications to become an inflation device that is able to be cooperated with the British style tire valve. The outlet end 512 can be directly defined at an end of the passage 511 of the tire pump 50 such that the first outer threads 211 and the second outer threads 34 can be connected with the outlet end 512. On another way, the hose 53 has the connection member 54 at an end thereof, and therefore the first outer threads 211 and the second outer threads 34 may be connected with the connection member 54 of the hose 53.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An inflation device, comprising:

a hollow central tube including a reception end at a first end of the central tube and a connection portion at a second end of the central tube, wherein a valve mouth is disposed in the reception end, a flange extends radially outward from the connection portion, a first O-ring is located between the flange and the reception end, a first groove is defined on an outside of the connection portion, a second O-ring is engaged with the first groove, and threads are defined on an outer periphery of a distal end of the connection portion;

a first mounting unit having a first casing and a locking ring, wherein a first space is defined in the first casing, the reception end of the central tube is received in the first space, a first threaded hole is defined in an inner periphery of the first casing and disposed beside the first space, the locking ring has an opening, the central tube extends through the opening, the locking ring is connected with the first casing so as to enclose the reception end of the central tube, the flange and the first O-ring, the flange is pressed against the opening of the locking ring, the first threaded hole is adapted to be connected with an American style tire valve, and the first mounting unit is rotatable and adapted to move the American style tire valve into the first mounting unit; and a second mounting unit having inner threads and a second threaded hole in an inner periphery thereof, wherein a second space is defined beside the inner threads, a second groove is defined beside the second threaded hole, the inner threads are threadedly connected with the threads on the connection portion, the second space accommodates the second O-ring in the first groove, a third O-ring is engaged with the second groove, the second threaded hole is adapted to be connected with a French style tire valve, and the second mounting unit is rotatable and adapted to move the French style tire valve into the second mounting unit;

wherein the inner threads of the second mounting unit is glued to the threads of the central tube so that the second mounting unit is co-rotated with the central tube and the first mounting unit is rotatable relative to the reception end of the central tube.

2. The inflation device as claimed in claim 1, wherein the valve mouth in the reception end of the central tube comprises a core tube received therein.

3. The inflation device as claimed in claim 1, wherein the central tube comprises an inner tube at the second end thereof and the inner tube communicates with the reception end.

4. The inflation device as claimed in claim 1, wherein a reception groove is defined between the reception end of the central tube and the flange, and the first O-ring is engaged with the reception groove.

5. The inflation device as claimed in claim 1, wherein the first casing includes a first threaded portion and the locking ring includes a second threaded portion which is threadedly connected with the first threaded portion, and the reception end of the central tube is received between the first casing and the locking ring.

6. The inflation device as claimed in claim 1, wherein the first mounting unit includes first outer threads on an outside of the first threaded hole and the second mounting unit includes second outer threads on an outside of the second threaded hole.

7. The inflation device as claimed in claim 6, wherein a diameter of the first outer threads is the same as that of the second outer threads.

8. An inflation device, comprising:

a hollow central tube including a valve mouth connected to a first end of the central tube, a connection portion formed on a second end of the central tube, a flange extending radially outward between the valve mouth and the connection portion, and threads defined on an outside of the connection portion;

a first mounting unit having a first casing and a locking ring, wherein a first space is defined in the first casing, the valve mouth is received in the first space, a first threaded hole is defined in an inner periphery of the first casing and disposed beside the first space, the locking ring has an opening, the central tube extends through the opening, the locking ring is connected with the first casing so as to enclose the valve mouth, the first threaded hole is adapted to be connected with an American style tire valve, and the first mounting unit is rotatable and adapted to move the American style tire valve into the first mounting unit; and a second mounting unit having inner threads and a second threaded hole in an inner periphery thereof, wherein a second space is defined beside the inner threads, a second groove is defined beside the second threaded hole, the inner threads are threadedly connected with the threads on the connection portion, a third O-ring is engaged with the second groove, and the second threaded hole is adapted to be connected with a French style tire valve, the second mounting unit is rotatable and adapted to move the French style tire valve into the second mounting unit;

wherein the first mounting unit includes first outer threads on an outside of the first threaded hole and the second mounting unit includes second outer threads on an outside of the second threaded hole, a diameter of the first outer threads is the same as that of the second outer threads.

9. The inflation device as claimed in claim 8, wherein the central tube includes a reception end at the first end thereof so as to receive the valve mouth, a reception groove is defined between the reception end of the central tube and the flange, a first O-ring is engaged with the reception groove, a first groove is defined on an outside of the connection portion, and a second O-ring is engaged with the first groove.

10. The inflation device as claimed in claim 9, wherein the locking ring is connected with the first casing so as to enclose the flange and the outer periphery of the first O-ring, and the flange is pressed against the opening of the locking ring.

11. The inflation device as claimed in claim 9, wherein the second O-ring is engaged with the first groove, and the second space of the second mounting unit is mounted onto an outer periphery of the second O-ring.

12. The inflation device as claimed in claim 9, wherein the inner threads of the second mounting unit and the threads of the central tube are glued together so that the second mounting unit is co-rotated with the central tube and the reception end of the central tube is rotatable relative to the first mounting unit.

13. The inflation device as claimed in claim 9, wherein the valve mouth in the reception end of the central tube includes a core tube received therein.

14. The inflation device as claimed in claim 9, wherein the central tube includes an inner tube at the second end thereof and the inner tube communicates with the reception end.

15. The inflation device as claimed in claim 8, wherein a reception groove is defined between the valve mouth and the flange, a first O-ring is engaged with the reception groove.

16. The inflation device as claimed in claim 8, wherein the first casing includes a first threaded portion and the locking ring includes a second threaded portion which is threadedly connected with the first threaded portion.

* * * * *